US009213295B2

(12) United States Patent
Shimada et al.

(10) Patent No.: US 9,213,295 B2
(45) Date of Patent: Dec. 15, 2015

(54) GLOSSING DEVICE AND IMAGE FORMING APPARATUS INCORPORATING SAME

(71) Applicants: Hiroyuki Shimada, Kanagawa (JP); Akiyasu Amita, Kanagawa (JP)

(72) Inventors: Hiroyuki Shimada, Kanagawa (JP); Akiyasu Amita, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 234 days.

(21) Appl. No.: 13/915,036

(22) Filed: Jun. 11, 2013

(65) Prior Publication Data

US 2014/0016975 A1 Jan. 16, 2014

(30) Foreign Application Priority Data

Jul. 10, 2012 (JP) ..... 2012-154493

(51) Int. Cl.
*G03G 21/20* (2006.01)
*G03G 15/00* (2006.01)
*G03G 15/20* (2006.01)

(52) U.S. Cl.
CPC ..... *G03G 15/6585* (2013.01); *G03G 15/6582* (2013.01); *G03G 21/206* (2013.01); *G03G 15/2017* (2013.01)

(58) Field of Classification Search
CPC ..... G03G 2215/2032; G03G 15/2021; G03G 15/6582; G03G 15/2017; G03G 15/6585; G03G 21/206
USPC ..... 399/92, 341, 407
See application file for complete search history.

(56) References Cited

U.S. PATENT DOCUMENTS

| | | | | |
|---|---|---|---|---|
| 6,397,033 | B1 * | 5/2002 | Todome | 399/303 |
| 8,892,015 | B2 * | 11/2014 | Kunii et al. | 399/328 |
| 2002/0057934 | A1 * | 5/2002 | Ishikawa et al. | 399/328 |
| 2003/0165348 | A1 | 9/2003 | Amita et al. | |
| 2004/0245241 | A1 | 12/2004 | Kishi et al. | |
| 2004/0247332 | A1 | 12/2004 | Kishi et al. | |
| 2004/0247334 | A1 | 12/2004 | Kishi et al. | |
| 2004/0258426 | A1 | 12/2004 | Kishi et al. | |
| 2005/0139584 | A1 | 6/2005 | Kishi et al. | |
| 2005/0175368 | A1 | 8/2005 | Matsusaka et al. | |
| 2005/0175370 | A1 | 8/2005 | Matsusaka et al. | |
| 2005/0191078 | A1 | 9/2005 | Kishi et al. | |
| 2006/0029411 | A1 | 2/2006 | Ishii et al. | |
| 2006/0039713 | A1 | 2/2006 | Kishi et al. | |

(Continued)

FOREIGN PATENT DOCUMENTS

| | | |
|---|---|---|
| JP | 5-333643 | 12/1993 |
| JP | 2004-325934 | 11/2004 |

(Continued)

*Primary Examiner* — David Gray
*Assistant Examiner* — Andrew V Do
(74) *Attorney, Agent, or Firm* — Harness, Dickey & Pierce

(57) ABSTRACT

A glossing device for imparting gloss to a toner image formed on a recording medium includes a plurality of rollers, a looped, endless belt, a pressure member, a belt cooler, and a belt retention mechanism. The plurality of rollers is disposed generally parallel to each other, and includes a heat roller subjected to heating. The looped, endless belt is entrained around the plurality of rollers for conveying the recording medium in a longitudinal, conveyance direction thereof. The pressure member is disposed opposite the heat roller to press against the heat roller via the belt to form a glossing nip therebetween, through which the recording medium passes. The belt cooler is disposed inside the loop of the belt to cool the belt during movement between the glossing nip and the separation position.

9 Claims, 6 Drawing Sheets

(56) References Cited

U.S. PATENT DOCUMENTS

| | | | |
|---|---|---|---|
| 2006/0051111 | A1 | 3/2006 | Kishi et al. |
| 2006/0051112 | A1 | 3/2006 | Matsusaka et al. |
| 2006/0051113 | A1 | 3/2006 | Kishi et al. |
| 2006/0051119 | A1 | 3/2006 | Kishi et al. |
| 2006/0051120 | A1 | 3/2006 | Kishi et al. |
| 2006/0051121 | A1 | 3/2006 | Matsusaka et al. |
| 2006/0127118 | A1 | 6/2006 | Kishi et al. |
| 2006/0165443 | A1 | 7/2006 | Yoshinaga et al. |
| 2006/0177232 | A1 | 8/2006 | Ehara et al. |
| 2006/0182460 | A1 | 8/2006 | Kishi et al. |
| 2006/0257183 | A1 | 11/2006 | Ehara et al. |
| 2007/0014600 | A1 | 1/2007 | Ishii et al. |
| 2007/0031159 | A1 | 2/2007 | Kishi et al. |
| 2007/0036573 | A1 | 2/2007 | Kishi et al. |
| 2007/0212090 | A1 | 9/2007 | Matsusaka et al. |
| 2008/0145088 | A1 | 6/2008 | Matsusaka et al. |
| 2009/0123172 | A1 | 5/2009 | Kishi et al. |
| 2009/0274477 | A1 | 11/2009 | Okamoto et al. |
| 2009/0274494 | A1 | 11/2009 | Okamoto et al. |
| 2009/0274495 | A1 | 11/2009 | Okamoto et al. |
| 2009/0274496 | A1 | 11/2009 | Okamoto et al. |
| 2009/0274497 | A1 | 11/2009 | Okamoto et al. |
| 2009/0274498 | A1 | 11/2009 | Okamoto et al. |
| 2009/0317113 | A1 | 12/2009 | Kishi et al. |
| 2011/0064494 | A1 | 3/2011 | Amita et al. |
| 2011/0085815 | A1 | 4/2011 | Kishi et al. |
| 2011/0176822 | A1 | 7/2011 | Ishii et al. |
| 2011/0188911 | A1 | 8/2011 | Kunii et al. |
| 2012/0008153 | A1 | 1/2012 | Kunii et al. |
| 2012/0201579 | A1 | 8/2012 | Kunii et al. |
| 2012/0224898 | A1 | 9/2012 | Amita et al. |
| 2012/0328343 | A1 | 12/2012 | Kunii et al. |
| 2012/0328344 | A1 | 12/2012 | Kunii et al. |
| 2012/0328345 | A1 | 12/2012 | Kunii et al. |
| 2012/0328346 | A1 | 12/2012 | Amita et al. |
| 2013/0004220 | A1 | 1/2013 | Muramatsu et al. |

FOREIGN PATENT DOCUMENTS

| | | |
|---|---|---|
| JP | 2006-243444 | 9/2006 |
| JP | 2007-286510 | 11/2007 |
| JP | 2009-014876 | 1/2009 |

* cited by examiner

GLOSSING DEVICE AND IMAGE FORMING APPARATUS INCORPORATING SAME

CROSS-REFERENCE TO RELATED APPLICATION

The present patent application claims priority pursuant to 35 U.S.C. §119 from Japanese Patent Application No. 2012-154493, filed on Jul. 10, 2012, which is hereby incorporated by reference herein in its entirety.

BACKGROUND

1. Technical Field

The present invention relates to a glossing device and an image forming apparatus incorporating the same, and more particularly, to a glossing device for imparting gloss to a toner image formed on a recording medium, and an image forming apparatus, such as a photocopier, facsimile machine, printer, plotter, or multifunctional machine incorporating several of these features, incorporating the glossing device.

2. Background Art

Glossing devices are employed in image forming apparatuses, such as a photocopier, facsimile machine, printer, plotter, or multifunctional machine incorporating several of these features, where a toner image formed on a recording medium, such as a sheet of paper, is processed with heat and pressure to obtain a resulting print with a high gloss finish. The glossing process is one of several features incorporated in image forming apparatuses, particularly in color printers, where higher levels of gloss are required than those provided in monochrome printers.

Some glossing devices employ a belt-based assembly including a looped, endless belt entrained around a heat roller and other belt-support rollers, and a pressure member disposed opposite the heat roller to press against the heat roller via the belt to form a glossing nip therebetween, through which the recording sheet passes. The endless belt is equipped with a belt cooler, such as a heat sink, disposed inside the loop of the belt to cool the belt during movement downstream from the glossing nip.

During operation, the recording sheet enters the glossing device after passing through a fixing nip where the toner image is fixed in place with heat and pressure. At the glossing nip, heat and pressure applied to the recording sheet transforms the once-fixed toner image into a molten, adhesive state that exhibits adhesion to the conveyance surface of the belt, so that the toner image, which is cooled to solidify while conforming to the conveyance surface of the belt downstream from the glossing nip, assumes a smooth, glossy appearance.

Various types of belt-based glossing devices are known in the art. For example, one such technique employs a single endless belt to define a conveyance surface on which the recording medium is conveyed with its printed face directed downward. A belt cooler is disposed adjacent to the endless belt moving downstream from the glossing nip, such that the recording sheet during conveyance faces the belt cooler via the belt therebelow.

Another technique employs a pair of opposed, endless belts, one upper and the other lower, to define a conveyance path therebetween along which the recording medium is conveyed with its printed face directed upward. A belt cooler is disposed adjacent to the upper one of the paired endless belts moving downstream from the glossing nip, such that the recording sheet during conveyance faces the belt cooler via the belt thereabove.

The inventors have recognized that one problem associated with a glossing device employing an endless belt assembly with a belt cooler is that the belt occasionally separates from the belt cooler due to loosening or slackening of the belt. Separation of the belt from the belt cooler, if not corrected, would result in reduced cooling efficiency with the belt cooler and concomitant degradation of imaging performance of the glossing device.

SUMMARY

Exemplary aspects of the present invention are put forward in view of the above-described circumstances, and provide a novel glossing device for imparting gloss to a toner image formed on a recording medium.

In one exemplary embodiment, the glossing device includes a plurality of rollers, a looped, endless belt, a pressure member, a belt cooler, and a belt retention mechanism. The plurality of rollers is disposed generally parallel to each other, and includes a heat roller subjected to heating. The looped, endless belt is entrained around the plurality of rollers for conveying the recording medium in a longitudinal, conveyance direction thereof. The pressure member is disposed opposite the heat roller to press against the heat roller via the belt to form a glossing nip therebetween, through which the recording medium passes. The recording medium after passage through the glossing nip is conveyed on the belt with the toner image adhering to an outer, conveyance surface of the belt, and subsequently separates from the belt at a given separation position downstream from the glossing nip in the conveyance direction. The belt cooler is disposed inside the loop of the belt to cool the belt during movement between the glossing nip and the separation position. The belt retention mechanism is disposed adjacent to a pair of opposed lateral edges of the belt and outboard of a maximum width of the recording medium to retain the belt in continuous contact with the belt cooler between the glossing nip and the separation position.

Other exemplary aspects of the present invention are put forward in view of the above-described circumstances, and provide an image forming apparatus incorporating the glossing device.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
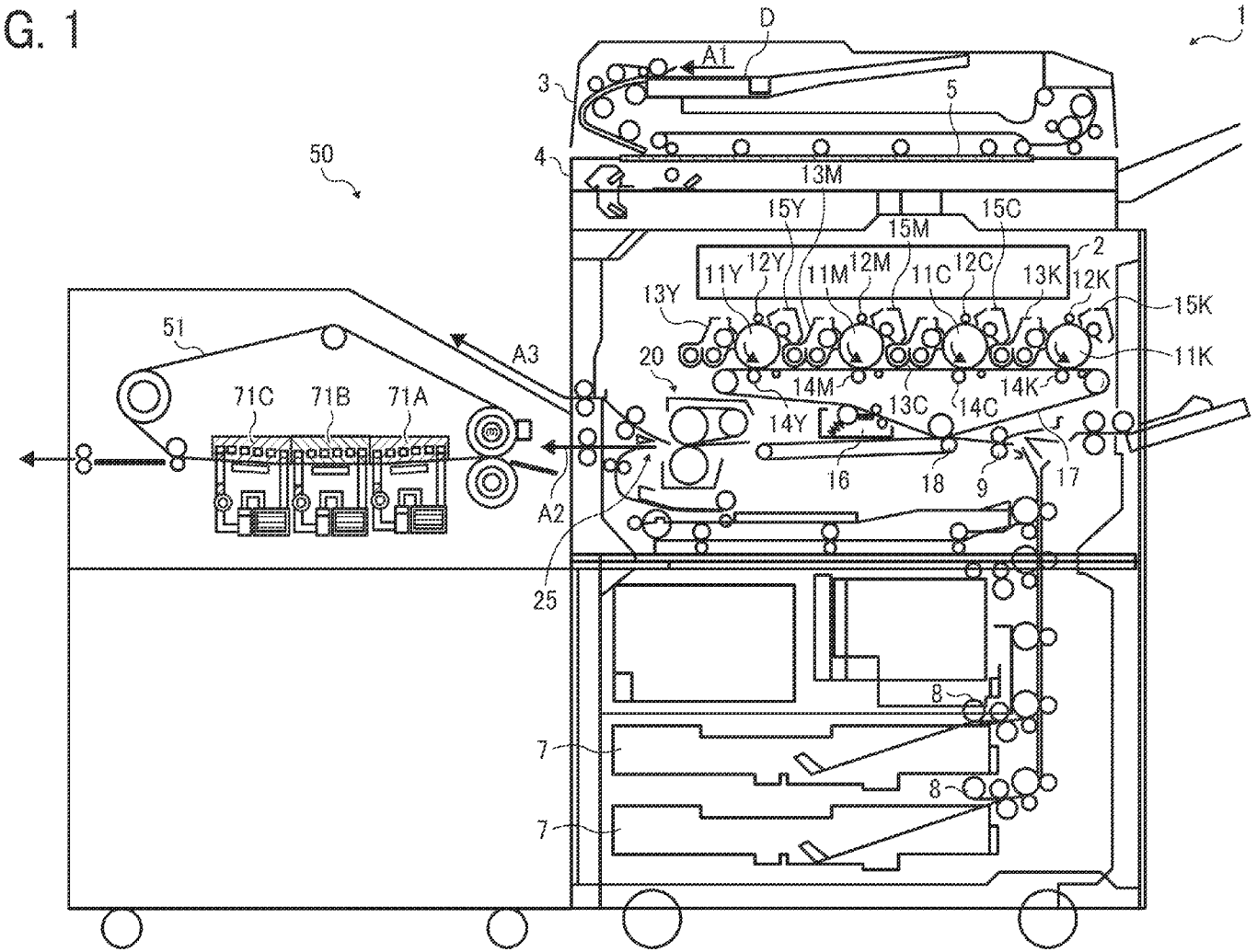
FIG. 1 schematically illustrates an image forming apparatus according to one or more embodiments of this patent specification.

In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views, exemplary embodiments of the present patent application are described.

FIG. 1 schematically illustrates an image forming apparatus 1 according to one or more embodiments of this patent specification.

As shown in FIG. 1, the image forming apparatus 1 comprises a tandem color printer that employs four imaging stations, including photoconductors 11Y, 11M, 11C, and 11K arranged in series, for forming toner images with four different colors, as designated by the suffix letters, "Y" for yellow, "M" for magenta, "C" for cyan, and "K" for black. Since the imaging stations are of an identical configuration except for the color of toner used for image formation, features of the photoconductor and its associated imaging equipment described herein apply to all the imaging stations unless otherwise indicated.

In each imaging station, the photoconductor 11 is rotatable in a given rotational direction counterclockwise in FIG. 1, while surrounded by various pieces of imaging equipment, including a discharging device, a charging device 12, a development device 13, and a cleaning device 15, with an exposure device 2 directing a laser beam to the photoconductive surface, which work in cooperation with each other to form a toner image on the photoconductive surface.

Also included in the image forming apparatus 1 is an intermediate transfer device including an intermediate transfer belt 17 disposed opposite the photoconductors 11Y, 11M, 11C, and 11K. The intermediate transfer belt 17 is entrained about a plurality of belt-support rollers for rotation in a given rotational direction clockwise in FIG. 1.

Four primary transfer rollers 14Y, 14M, 14C, and 14K are disposed opposite the photoconductors 11Y, 11M, 11C, and 11K, respectively, via the intermediate transfer belt 17 to form four primary transfer nips therebetween, through each of which the toner image is primarily transferred from the photoconductor 11 to the belt 17.

A secondary transfer roller 18 is disposed opposite the belt-support roller via the intermediate transfer belt 17 to form a secondary transfer nip therebetween, through which the toner image is secondarily transferred from the belt 17 to a recording medium, such as a sheet of paper S. A belt cleaner 16 may be disposed opposite the belt-support roller to remove untransferred, residual toner particles that remain on the belt surface after secondary image transfer.

Situated atop the apparatus 1 is a scanning unit including a document feeder 3 for conveying an original document D, as well as an optical image scanner 4 that captures image data from the original document D placed on an exposure glass 5.

At the bottom of the apparatus 1 lies one or more sheet trays 7 each accommodating a stack of recording sheets S. A feed roller 8 is disposed at an outlet of the sheet tray 7 to advance the recording sheet S into a sheet conveyance path defined by a suitable sheet conveyance device, including, for example, a pair of registration rollers 9 for introducing the recording sheet S into the secondary transfer nip.

Downstream from the secondary transfer nip along the sheet conveyance path is a fixing device 20 including a pair of fixing members, such as an endless fuser belt and a pressure roller, disposed opposite each other to form a fixing nip therebetween, through which the recording sheet S is conveyed after secondary transfer.

A sheet diverter 25 is provided downstream from the fixing device 20, which directs the recording sheet S to different destinations depending on different modes of operation specified, for example, by a user through a control panel including user-operable buttons provided on the apparatus 1.

The image forming apparatus 1 also includes a glossing device 50 disposed downstream from the fixing device 20 for imparting gloss to the toner image formed on the recording sheet S. A detailed description will be given later of configuration and operation of the glossing device 50 and its associated structure, with reference to FIG. 2 and subsequent drawings.

During operation, to print a color image with the image forming apparatus 1, a user initially places an original document D in position on the document feeder 3, which then directs the original document D toward the exposure glass 5, for example, with a conveyance roller, as indicated by an arrow A1 in FIG. 1. The original document D thus advanced over the exposure glass 5 has its bottom face scanned by the optical image scanner 4.

In the optical image scanner 4, a light beam emitted from a lamp is reflected off the document surface to pass through a series of mirrors and lenses to converge at the surface of a color sensor, which divides the incoming light into red, green, blue (RGB) color components, and converts the respective colors into electrical signals for processing by a digital image processor. The digital image processor then performs a series of computation, such as color conversion, color correction, and spatial frequency analysis, on the incoming signals to obtain image data for the four primary colors (i.e., yellow, magenta, cyan, and black) for output to the exposure device 2.

In the exposure device 2, a laser source emits laser beams modulated according to the image data for the respective primary colors, each of which then reflects off facets of a rapidly spinning polygon mirror to pass along a different light path to enter an associated one of the imaging stations. Thus, from left to right in FIG. 1, a laser beam representing an yellow component is directed toward the photoconductor 11Y in the yellow imaging station, a laser beam representing a magenta component toward the photoconductor 11M in the magenta imaging station, a laser beam representing a cyan component toward the photoconductor 11C in the cyan imaging station, and a laser beam representing a black component toward the photoconductor 11K in the black imaging station.

In each imaging station, the photoconductor 11 rotates to forward its outer, photoconductive surface to a series of electrophotographic processes, including charging, exposure, development, transfer, and cleaning, in one rotation of the photoconductor 11.

First, after being exposed to light radiation from the discharging device, which removes residual electrical charges for initialization, the photoconductive surface is uniformly charged by the charging device 12 and subsequently exposed to the modulated laser beam moving in an axial, longitudinal direction of the drum-shaped photoconductor 11.

The laser exposure selectively dissipates the charge on the photoconductive surface to form an electrostatic latent image thereon according to image data representing a particular primary color. Then, the latent image enters the development device 13, which renders the incoming image visible using toner. The toner image thus obtained is forwarded to the primary transfer nip between the photoconductor 11 and the primary transfer roller 14.

At the primary transfer nip, the primary transfer roller 14 is supplied with a bias voltage of a polarity opposite that of the toner on the photoconductor 11. This electrostatically transfers the toner image from the photoconductive surface to an outer surface of the belt 17, with a certain small amount of residual toner particles left on the photoconductive surface. Such transfer process occurs sequentially at the four primary transfer nips along the belt travel path, so that toner images of different colors are superimposed one atop another to form a single multicolor image on the surface of the intermediate transfer belt 17.

After primary transfer, the photoconductive surface enters the cleaning device 15 to remove residual toner, and then to the discharging device to remove residual charges for completion of one imaging cycle. At the same time, the intermediate transfer belt 17 forwards the multicolor image to the secondary transfer nip between the belt-support roller and the secondary transfer roller 18.

Meanwhile, in the sheet conveyance path, the feed roller 8 rotates to introduce a recording sheet S from the sheet tray 7 toward the pair of registration rollers 9 being rotated. Upon receiving the fed sheet S, the registration rollers 9 stop rotation to hold the incoming sheet S therebetween, and then advance it in sync with the movement of the intermediate transfer belt 17 to the secondary transfer nip. At the secondary transfer nip, the multicolor image is transferred from the belt 17 to the recording sheet S, with a certain small amount of residual toner particles left on the belt surface.

After secondary transfer, the intermediate transfer belt 17 enters the belt cleaner 16, which removes residual toner from the intermediate transfer belt 17. At the same time, the recording sheet S bearing the powder toner image thereon is introduced into the fixing device 20, in which the incoming sheet S passes through the fixing nip to fix the multicolor image in place with heat and pressure.

Thereafter, the recording sheet S is advanced to the sheet diverter 25 for transfer to a further destination, which varies depending on the user-specified operational mode of the image forming apparatus 1.

For example, where the user specifies a gloss mode for obtaining a resulting print with a high gloss finish, such as that required for photographic printing applications, the sheet diverter 25 introduces the sheet S into the glossing device 50, as indicated by an arrow A2 in FIG. 1. Conversely, where the gloss mode is not specified, the sheet diverter 25 outputs the sheet S to outside the image forming apparatus 1, as indicated by an arrow A3 in FIG. 1, to complete one cycle of image formation.

In the glossing device 50, the incoming sheet S is subjected to heat and pressure, followed by subsequent cooling to gloss the toner image. After glossing, the recording sheet S may be output to outside the glossing device 50 to complete one cycle of image formation.

A description is now given of specific features of the glossing device 50 incorporated in the image forming apparatus 1 according to one or more embodiments of this patent specification. In each of these embodiments, the glossing device 50 is described as peripheral equipment located outside, and connected to, the image forming apparatus 1. It is to be noted, however, the glossing device 50 may be configured otherwise than described herein, and can be disposed either inside or outside of the image forming apparatus 1 depending on specific applications.

Figure 2:
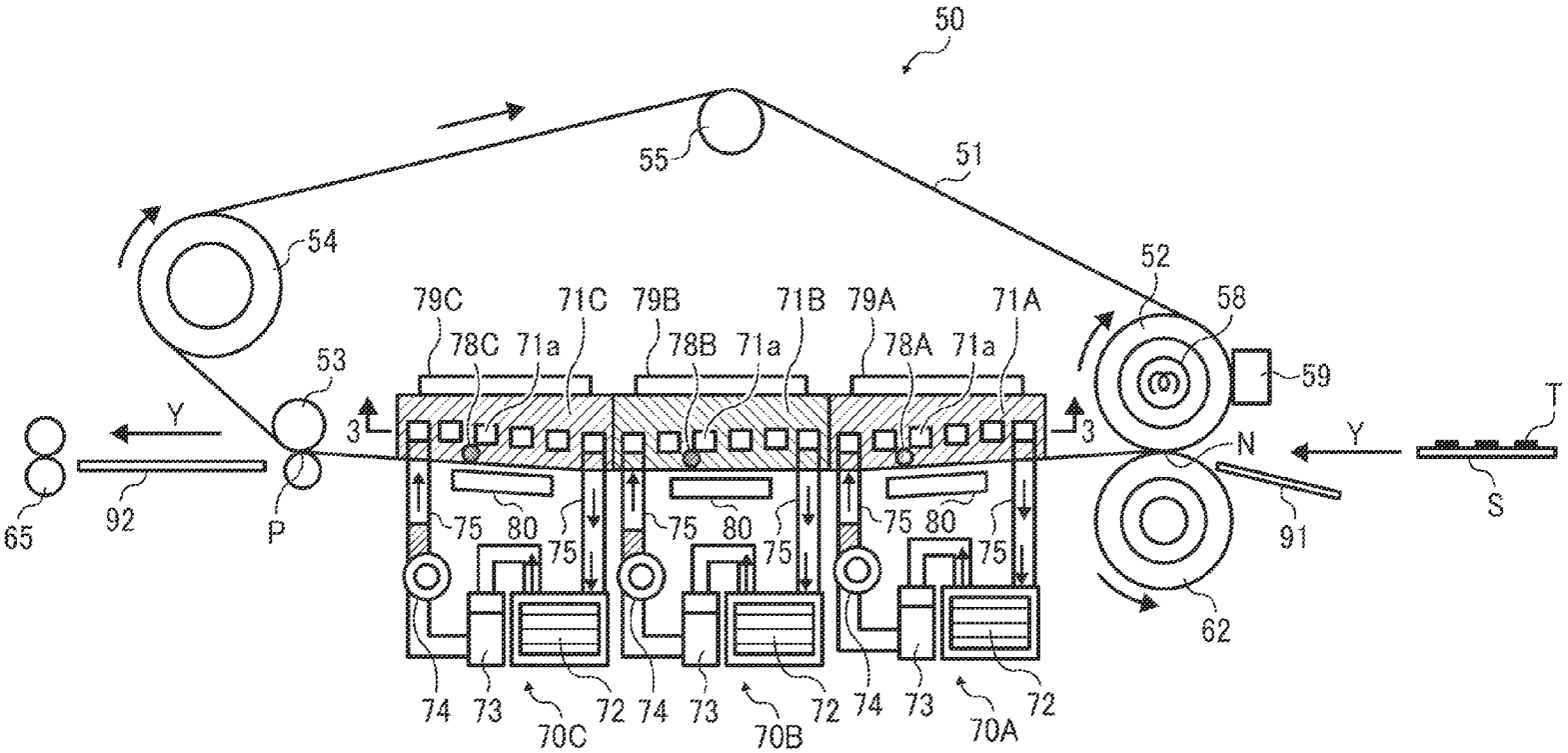
FIG. 2 is an end-on, partially cross-sectional view of a glossing device according to one embodiment of this patent specification.

FIG. 2 is an end-on, partially cross-sectional view of the glossing device 50 according to one embodiment of this patent specification.

As shown in FIG. 2, the glossing device 50 includes a plurality of rollers disposed generally parallel to each other, including a heat roller 52 subjected to heating, a looped, endless belt 51 entrained around the plurality of rollers for conveying the recording medium or sheet S in a longitudinal, conveyance direction Y thereof, and a pressure member 62 disposed opposite the heat roller 52 to press against the heat roller 52 via the belt 51 to form a glossing nip N therebetween, through which the recording medium S passes.

The recording medium S after passage through the glossing nip N is conveyed on the belt 51 with the toner image T adhering to an outer, conveyance surface of the belt 51, and subsequently separates from the belt 51 at a given separation position P downstream from the glossing nip N in the conveyance direction Y.

Also included in the glossing device 50 are a belt cooler 71 inside the loop of the belt 51 to cool the belt 51 during movement between the glossing nip N and the separation position P, and a belt retention mechanism 80 disposed adjacent to a pair of opposed lateral edges of the belt 51 and outboard of a maximum width of the recording medium S to retain the belt 51 in continuous contact with the belt cooler 71 between the glossing nip N and the separation position P.

Specifically, in the present embodiment, the endless belt 51 is entrained around a separation roller 53, a driver roller 54, and a tension roller 55 in addition to the heat roller 52. A heater 58 is disposed adjacent to the heat roller 52 to heat the heat roller 52, from which heat is imparted to the belt 51 to in turn heat the recording sheet S at the glossing nip N. A temperature sensor 59, such as a thermistor or thermometer, is disposed in contact with the belt 51 to measure temperature of the belt 51 around the heat roller 52. A rotary driver is connected to the driver roller 54 to impart torque to the driver roller 54.

Additionally, an inlet guide plate 91 may be disposed upstream from the glossing nip N to introduce the recording sheet S into the glossing nip N. An outlet guide plate 92 may be disposed downstream from the separation position P to introduce the recording sheet S to between a pair of conveyance rollers 65 after separation from the belt 51.

During operation, the glossing device 50 is activated upon power-on of the image forming apparatus 1, which is triggered, for example, by a user pressing a power-on button on the control panel.

Upon activation, the power supply circuit supplies power to the heater 58 to heat the heat roller 52. Simultaneously, the rotary driver starts rotating the driver roller 54 in a given rotational direction, clockwise in FIG. 2, from which the torque is transmitted through friction to the endless belt 51 as well as to the other rollers 52, 53, and 55 to rotate the belt assembly in the same rotational direction. The endless belt 51 thus driven by the driver roller 52 may rotate at a linear conveyance speed of, for example, approximately 50 to 700 millimeters per second (minis).

Then, the recording sheet S is introduced into the glossing nip N along the inlet guide plate 91, with its printed face (that is, the surface on which a toner image T has been fixed in place) brought into contact with the outer, conveyance surface of the belt 51. Heating of the belt 51 may be controlled through on-off control of the heater 58 to maintain the temperature measured by the temperature sensor 59 to a set-point temperature of 150 degrees Celsius (° C.), in which case the printed face of the recording sheet S is heated to approximately 100 to 120° C. upon passage through the glossing nip N.

At the glossing nip N, heat and pressure applied to the recording sheet S transforms the once-fixed toner image T into a molten, adhesive state that exhibits adhesion to the conveyance surface of the belt 51. After exiting the glossing nip N, the recording sheet S remains attached to the conveyance surface of the belt 51 due to adhesion of the molten toner T, while cooled as the belt cooler 71 absorbs heat from the belt 51 moving downstream from the glossing nip N.

Upon reaching the separation position P, the recording sheet S separates from the belt 51 owing to curvature of the separation roller 53. At this point, the toner image T, which is cooled to solidify while conforming to the conveyance surface of the belt 51 between the glossing nip N and the separation position P, assumes a smooth, glossy appearance. Cooling of the belt 51 may be controlled such that the printed face of the recording sheet S is cooled to a temperature not exceeding 40° C. upon separation from the belt 51, in which case the toner image T may exhibit a 20-degree gloss of approximately 65 to 80.

After separation from the belt 51, the recording sheet S is advanced along the outlet guide plate 92 to reach the pair of conveyance rollers 65, which forwards the outgoing sheet S to a subsequent destination outside from the glossing device 50.

More specifically, in the present embodiment, the endless belt 51 comprises a flexible looped belt formed of a substrate of heat-resistant resin, approximately 10 to 300 μm thick, on which an outer coating of suitable material, approximately 1 to 100 μm thick, is deposited to form an outer, conveyance surface for conveying the recording sheet S thereon. In the present embodiment, the belt 51 is a multilayered belt with a thickness of approximately 90 μm.

The substrate of the belt 51 may be formed of a sheet of suitable polymer, such as polyester, polyethylene, polyethylene terephthalate, polyethersulfone, polyetherketone, polysulfone, polyimide, polyamide-imide, polyamide, or the like.

The outer coating of the belt 51 may be formed of a suitable resin, such as silicone resin, fluorine resin, or the like. For obtaining a sufficiently high gloss on the resultant print, which requires high smoothness of the conveyance surface of the belt, the outer coating may be configured to exhibit an arithmetic average surface roughness, Ra, of approximately 0.3 μm or less, preferably, approximately 0.1 μm or less.

The heat roller 52 comprises a hollow cylinder of thermally conductive material, such as aluminum or other suitable metal, with an outer diameter of approximately 50 to 120 mm, having a hollow interior for accommodating the heater 58 therein.

The heater 58 comprises a suitable heating element, such as a halogen heater, a carbon heater, an electromagnetic induction heating coil, or the like, stationarily disposed in the hollow interior of the heat roller 52 to radiate heat to the heat roller 52. In the present embodiment, the heater 58 is an elongated halogen heater with its opposed longitudinal ends secured to a pair of sidewalls of the glossing device 50.

Power supply to the heater 58 may be derived from an alternating current (AC) power supply controlled, for example, through on-off control circuitry that determines a duty cycle of the heating element according to readings of the temperature sensor 59. Such heater power control may be performed to maintain the belt temperature in a desired range of, for example, approximately 100 to 180° C. during operation.

The pressure roller 62 comprises a rotatable cylinder with an outer diameter of approximately 50 to 120 mm, constructed of a cylindrical core of metal upon which an intermediate elastic layer and an outer coating layer are deposited one upon another.

The intermediate elastic layer of the roller 62 is formed of an elastic material, such as silicone rubber or the like, approximately 5 to 30 mm thick. The outer coating layer of the roller 62 is formed of a suitable material, such as fluorine resin or the like, in the shape of a tubular sheath, approximately 30 to 200 μm thick.

The pressure roller 62 is equipped with a suitable biasing mechanism that presses the pressure roller 62 against the heat roller 52 via the belt 51 to establish the glossing nip N with a length of approximately 10 to 40 mm in the conveyance direction Y.

With continued reference to FIG. 2, the belt cooler 71 in the present embodiment is shown including one or more independent cooling members, disposed in series in the conveyance direction Y, each of which is operable independently from each other to be cooled to a specific temperature for cooling the belt 51.

Specifically, in the present embodiment, three independent cooling members are provided, including a first, upstream cooling member 71A, a second, midstream cooling member 71B, and a third, downstream cooling member 71C disposed adjacent to each other in the recited order from downstream to upstream in the conveyance direction Y.

The cooling members 71A, 71B, and 71C may slightly intrude into a common tangential plane between the heat roller 52 and the separation roller 53 along which the belt 52 extends, so that the belt cooler 71 can closely contact the inner circumferential surface of the belt 51 between the glossing nip N and the separation position P.

Providing the independent cooling members in series in the conveyance direction Y enables thermally efficient cooling of the belt 51, in which the upstream cooling member 71A, subjected to a relatively large amount of heat from the belt 51 immediately passing through the glossing nip N, is isolated from the midstream and downstream cooling members 71B and 71C, which can then operate without being affected by excessive heat from the belt 51. Such arrangement leads to sufficient cooling of the recording sheet S, and therefore excellent glossing performance of the glossing device 50, compared to a configuration in which the belt is cooled with only a single cooling member having its coolant heated continually while circulating from upstream to downstream in the conveyance direction Y, resulting in a relatively small temperature difference between the coolant and the surrounding air, which would adversely affect proper cooling of the recording medium in the glossing device.

Figure 3:
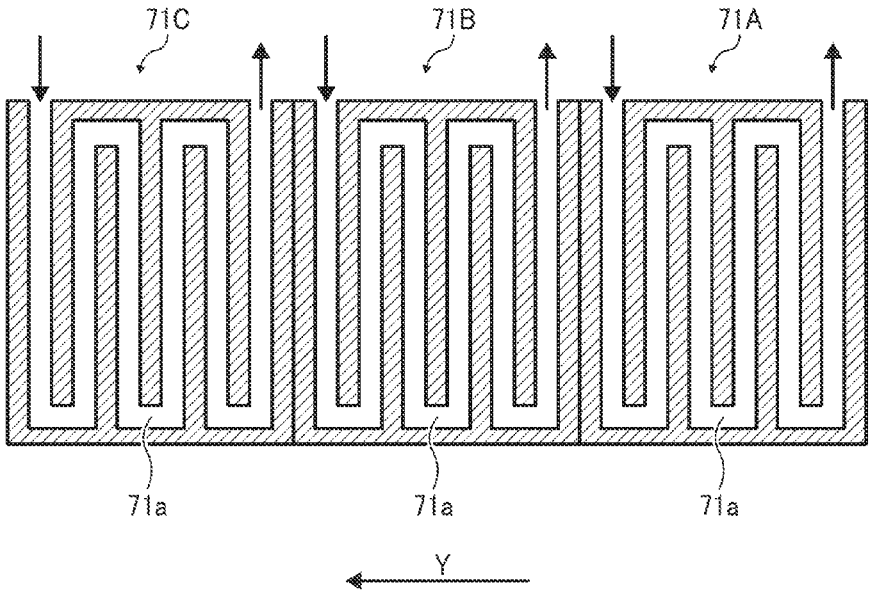
FIG. 3 is a cross-sectional view of a belt cooler included in the glossing device along lines 3-3 of FIG. 2.

With additional reference to FIG. 3, which is a cross-sectional view of the belt cooler 71 included in the glossing device 50 along lines 3-3 of FIG. 2, each cooling member 71 is shown comprising a liquid-cooled cold plate formed of thermally conductive material, such as aluminum or other suitable metal, in which a serpentine flow channel 71*a* is defined to allow a coolant liquid (for example, water) to flow in an alternate direction perpendicular to the conveyance direction Y.

As shown in FIG. 2, the cooling members 71A, 71B, and 71C are operatively connected with independent heat dissipaters 70A, 70B, and 70C, respectively, each of which includes a similar liquid-based cooling system operated independently from each other for dissipating heat conducted through the coolant liquid.

Specifically, in the present embodiment, the heat dissipator 70 includes a radiator 72 equipped with an electric fan for adjusting the amount of heat dissipated, a tank 73 for accommodating the coolant liquid, and a pump 74 for adjusting the flow of liquid coolant from the tank 73, all of which are connected together through a conduit 75.

Additionally, a suitable controller may be provided in the heat dissipator 70, which is operatively connected to the radiator 72 and the pump 74 to control cooling of the cooling member 71. Auxiliary temperature sensors or thermistors 78A, 78B, and 78C may be provided adjacent to the cooling members 71A, 71B, and 71C, respectively, to measure temperature of the cooling member 71 for output to the cooling controller.

The cooling controller may change the air flow rate of the fan-based radiator 72 within a range from 0 to 11 cubic meters per minute ($m^3$/min) according to readings of the auxiliary temperature sensor 78. The cooling controller may also change the liquid flow rate of the pump 74 within a range from 0 to 15 liters per minute (1/min) according to readings of the auxiliary temperature sensor 78.

Thus, provision of the independent heat dissipator 70 allows for adjusting the temperature of the cooling member 71 to a desired, optimal temperature by controlling operation of the radiator 71 and the pump 74 based on the operational temperature measured by the temperature sensor 78. In particular, cooling control through the variable liquid flow pump 74 provides a fast response time, which is effective where rapid cooling is required.

With still continued reference to FIG. 2, the glossing device 50 is shown further including an auxiliary heater 79 disposed adjacent to the belt cooler 71 to heat the belt cooler 71.

Specifically, in the present embodiment, the auxiliary heater 79 includes one or more independent heating elements 79A, 79B, and 79C, disposed in series in the conveyance direction Y, each of which is operable independently from each other to heat an associated one of the cooling members 71A, 71B, and 71C, respectively. For example, each of the heating elements 79A, 79B, and 79C may be configured as a planar heating element attached to an upper surface (i.e., the surface opposite that facing the belt 51) of the cooling member 71.

Additionally, a suitable heating controller may be provided, which is operatively connected to the heating element 79 to control heating of the cooling member 71 according to the temperature detected by the temperature sensor 78. The heating controller may activate the heating element 79 where the temperature measured by the temperature sensor 78 does not reach a lower threshold temperature, indicating that the cooling member 71 is excessively cold.

Provision of the auxiliary heater 79 allows for precisely adjusting the operational temperature of the belt cooler 71. Such arrangement allows for high stable glossing performance of the glossing device 50, as it prevents a delay in cooling the endless belt 51 to a sufficiently low temperature, for example, where the belt 51 absorbs excessive heat from the recording sheet S or other heat sources such as the heat roller 52 during sequential processing of multiple recording sheets S.

Moreover, providing the independent cooling members 71 with the dedicated heat dissipator 70 and the dedicated auxiliary heater 79 allows for adjusting the temperature of the cooling member 71 easily and swiftly to a desired temperature. In particular, protecting the belt cooler 71 against excessive cooling allows for energy efficient heating of the endless belt 51 for properly fusing the toner image at the glossing nip N even where the operational temperature of the belt cooler 71 is relatively low, such as immediately after power-on of the glossing device or during operation in a low-temperature environment.

Figure 4:
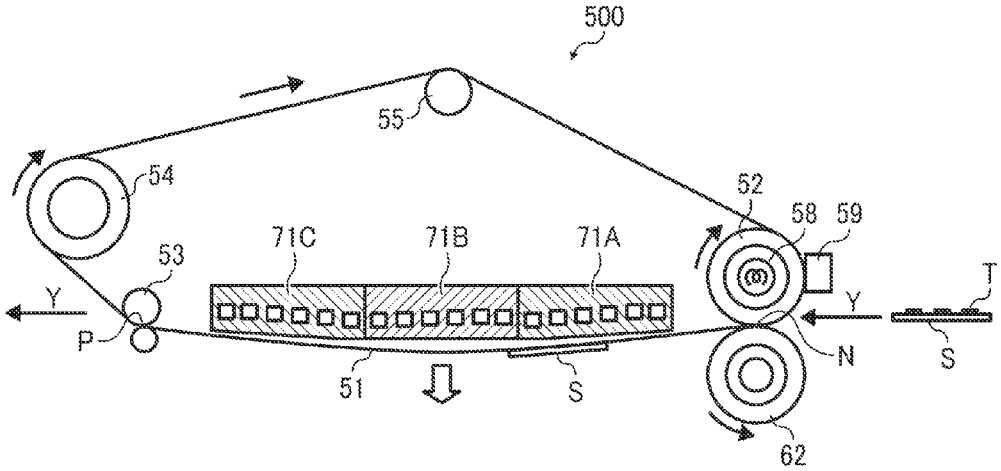
FIG. 4 is a schematic view of an exemplary glossing device.

Referring now to FIG. 4, which is a schematic view of an exemplary glossing device 500, the endless belt 51 is shown coming apart from the belt cooler 71 during movement between the glossing nip N and the separation position P.

The inventors have recognized that one problem associated with a glossing device employing an endless belt assembly with a belt cooler is that the belt 51 occasionally separates from the belt cooler 71 due to loosening or slackening of the belt 51. Separation of the belt 51 from the belt cooler 71, if not corrected, would result in reduced cooling efficiency with the belt cooler 71, and concomitant degradation of imaging performance of the glossing device 50.

The problem is particularly pronounced where the belt cooler 71 is disposed immediately above the conveyance surface of the belt 51, and where the distance between the glossing nip N and the separation position P is relatively long to accommodate the length of the belt cooler 71, which may include multiple independent cooling members arranged in series in the conveyance direction Y.

In such cases, the belt 51 tends to bend or sag downward by its own weight and that of the recording medium S attached to its outer, conveyance surface downstream from the glossing nip N. In addition, the relatively large distance between the glossing nip N and the separation position P results in a relatively large number of recording media S conveyed simultaneously on the conveyance surface, which adds to the total weight and the force exerted downward on the belt 51 to aggravate the tendency to bending or sagging of the belt 51.

To address the problem, one approach is to provide the belt assembly with the tension roller loaded with a strong biasing force to maintain sufficient tension in the belt. Although relatively easy to implement, this arrangement is impractical because a continuous, excessive load on the belt, resulting from strengthening the biasing force of the tension roller, can lead to accelerated degradation and premature failure of the belt material.

Another approach is to use a pair of endless belts, instead of a single endless belt, disposed opposite each other to define a conveyance path therebetween, along which the recording medium is conveyed. Although generally successful, this arrangement also has several drawbacks, including a relatively large size and costs involved in the dual-belt assembly, impaired image quality due to abrasion on the belt conveyance surface caused by frictional contact between the opposed endless belts, and undesired distortion or blurring of the toner image due to pressure between the opposed endless belts.

By contrast, the glossing device 50 according to this patent specification can effectively prevents separation of the belt from the belt cooler, owing to provision of the belt retention mechanism which is exempted from drawbacks described above, such as accelerated degradation and premature failure of the belt material, increased size and costs involved in the belt assembly, impaired image quality due to abrasion on the belt conveyance surface, and undesired distortion or blurring of the resultant toner image.

Figure 5:
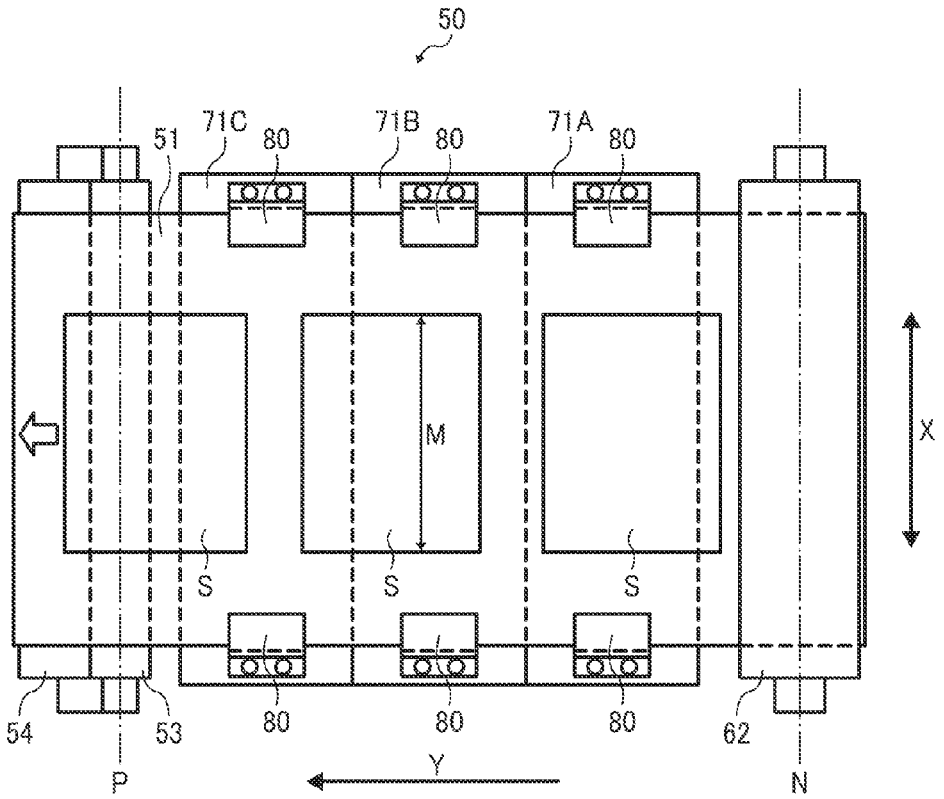
FIG. 5 is a bottom plan view of the glossing device of FIG. 2.

Specific arrangements of the belt retention mechanism and its associated structure according to several embodiments of this patent specification are now described in detail, with reference to FIG. 5 and subsequent drawings.

FIG. 5 is a bottom plan view of the glossing device 50 of FIG. 2.

As shown in FIG. 5, and as mentioned earlier, the glossing device 50 includes the belt retention mechanism 80 disposed adjacent to a pair of opposed lateral edges of the belt 51 and outboard of a maximum width M of the recording medium S to retain the belt 51 in continuous contact with the belt cooler 71 between the glossing nip N and the separation position P.

As used herein, the term "conveyance direction" refers to a longitudinal direction in which the endless belt 51 generally extends as it conveys the recording medium S thereon from the glossing nip N toward the separation position P, as indicated by arrow Y in the drawings. The term "axial direction" refers to a lateral direction, perpendicular to the conveyance direction Y, in which the plurality of belt-support rollers extend generally parallel to each other, as indicated by arrow X in the drawings.

The term "lateral edge" refers to an edge of the belt 51 extending parallel to the longitudinal, conveyance direction Y. The term "maximum width" as used herein refers to a maximum compatible size of the recording medium S that can be accommodated between the opposed lateral edges of the belt 51. Thus, the disposition adjacent to the belt lateral edges and outboard of the maximum width of the recording medium indicates that the belt retention mechanism may be positioned anywhere that is not normally reached by the recording medium S during conveyance on the belt 51.

Provision of the belt retention mechanism 80 prevents the belt 51 from separating from the belt cooler 71 due to loosening or slackening of the belt 51, which would otherwise result in reduced cooling efficiency with the belt cooler, and concomitant degradation of imaging performance of the glossing device. Moreover, positioning the belt retention mechanism 80 outboard of the maximum width of the recording medium S allows for properly retaining the belt 51 in position without damaging those areas of the belt 51 contacted by the recording medium S during operation.

Specifically, in the present embodiment, the belt retention mechanism comprises one or more pairs of stationary guide plates 80, each fixed in position to contact the lateral edge of the belt 51 moving between the glossing nip N and the separation position P. For example, where the belt cooler 71 is configured as three independent cooling members as in the present embodiment, three pairs of stationary guide plates 80 may be provided, each of which guide plate pair 80 is positioned facing an associated one of the multiple cooling members 71A, 71B, and 71C. In this example, the stationary guide plates 80 may be of an identical configuration.

Figure 6:
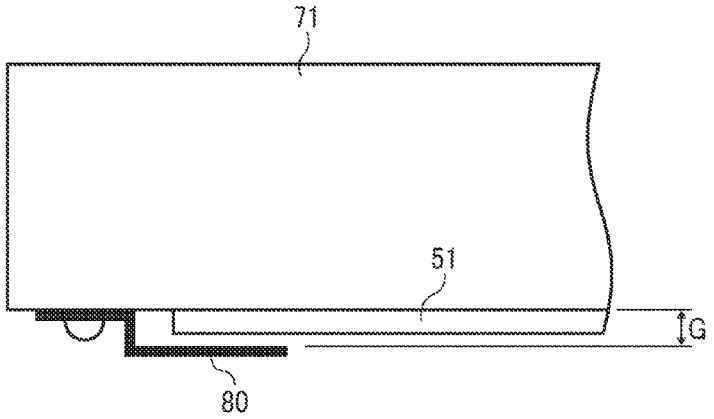
FIG. 6 is an enlarged elevational view of a belt retention mechanism included in the glossing device of FIG. 5

With additional reference to FIG. 6, which is an enlarged elevational view of the belt retention mechanism included in the glossing device 50 of FIG. 5, the guide plate 80 in the present embodiment is shown positioned facing the belt cooler 71 to define a gap G therebetween into which the lateral edge of the belt 51 is inserted.

More specifically, in the present embodiment, the stationary guide plate 80 is configured as a Z-shaped bracket formed of suitable material, such as metal or resin. The Z-shaped bracket may have its one, free end directed laterally inward and spaced apart from the belt cooler 71, and its other, fixed end directed laterally outward and fastened to the belt cooler 71, for example, through screwing.

Further, in the present embodiment, the gap G between the belt cooler 71 and the guide plate 80 is sized no more than ten times the thickness of the belt 51. For example, where the belt 51 has a thickness of 90 μm, the size of the gap G may be set to no more than 0.9 mm, and preferably, equal to or smaller than 0.5 mm.

Setting the size of the gap G to a sufficiently small range ensures that the belt 51 does not come excessively far away from the belt cooler 71. Such arrangement enables the belt retention mechanism 80 to reliably retain the belt 51 in close contact with the belt cooler 71, leading to good cooling efficiency and good imaging performance of the glossing device 50.

Furthermore, in the present embodiment, a low-friction material may be disposed on the guide plate 80 to reduce friction where the guide plate 80 contacts the lateral edge of the belt 51. The low-friction material may be configured as either a separate or an integral part of the guide plate 80. For example, the guide plate 80 may have its slidable contact surface covered with a coating of low-friction material. Alternatively, instead, a thin sheet of low-friction material may be bonded to the slidable contact surface of the guide plate 80.

Provision of the low-friction material allows for reducing frictional resistance at the interface between the stationary guide plate 80 and the endless belt 51, which would otherwise result in increased torque or other adverse effects on the belt assembly.

Still further, in the present embodiment, the belt cooler 71 is positioned immediately above the belt 51 between the glossing nip N and the separation position P, and the belt retention mechanism 80 is positioned immediately below the belt 51 between the glossing nip N and the separation position P.

Positioning the belt retention mechanism 80 below the belt 51 allows for reliably retaining the belt 51 in position where the belt 51 tends to bend or sag downward by its own weight and that of the recording medium S attached to its outer, conveyance surface downstream from the glossing nip N. Such arrangement is particularly effective where the distance between the glossing nip N and the separation position P is relatively long, which adds to the total weight and the force exerted on the belt to aggravate the belt tendency to bending or sagging downward.

Figure 7:
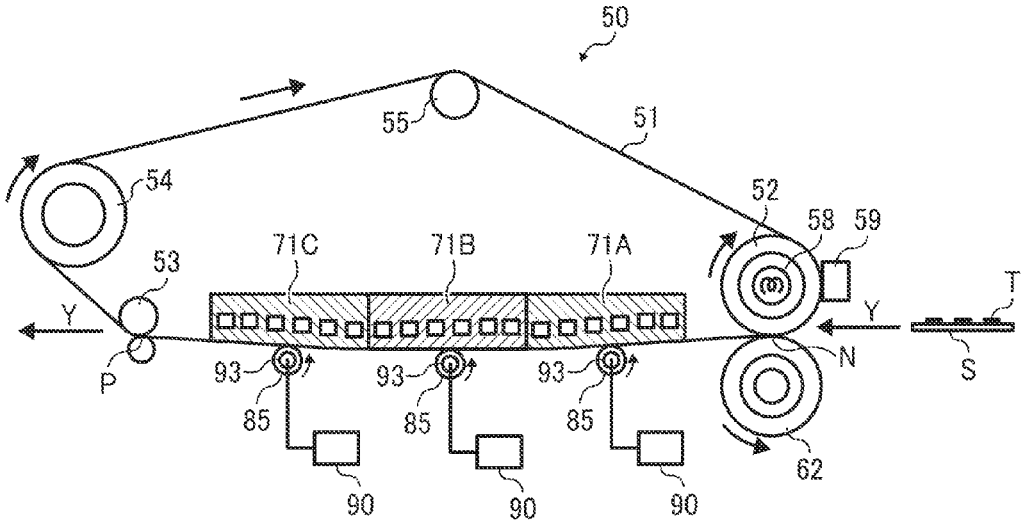
FIG. 7 is an end-on, partially cross-sectional view of the glossing device according to another embodiment of this patent specification.

FIG. 7 is an end-on, partially cross-sectional view of the glossing device 50 according to another embodiment of this patent specification, shown with several components omitted for brevity.

As shown in FIG. 7, the overall configuration of the glossing device 50 is similar to that depicted primarily with reference to FIG. 2, including a plurality of rollers disposed generally parallel to each other, including a heat roller 52, a looped, endless belt 51 entrained around the plurality of rollers for conveying the recording medium or sheet S in a longitudinal, conveyance direction Y thereof, and a pressure member 62 disposed opposite the heat roller 52 to press against the heat roller 52 via the belt 51 to form a glossing nip N therebetween, through which the recording medium S passes.

Also included in the glossing device 50 are a belt cooler 71 inside the loop of the belt 51 to cool the belt 51 during movement downstream from the glossing nip N, and a belt retention mechanism 85 disposed adjacent to a pair of opposed lateral edges of the belt 51 and outboard of a maximum width of the recording medium S to retain the belt 51 in continuous contact with the belt cooler 71 downstream from the glossing nip N.

As is the case with the foregoing embodiment, provision of the belt retention mechanism 85 prevents the belt 51 from separating from the belt cooler 71 due to loosening or slackening of the belt 51, which would otherwise result in reduced cooling efficiency with the belt cooler, and concomitant degradation of imaging performance of the glossing device. Moreover, positioning the belt retention mechanism 85 outboard of the maximum width of the recording medium S allows for properly retaining the belt 51 in position without damaging those areas of the belt 51 contacted by the recording medium S during operation.

Figure 8:
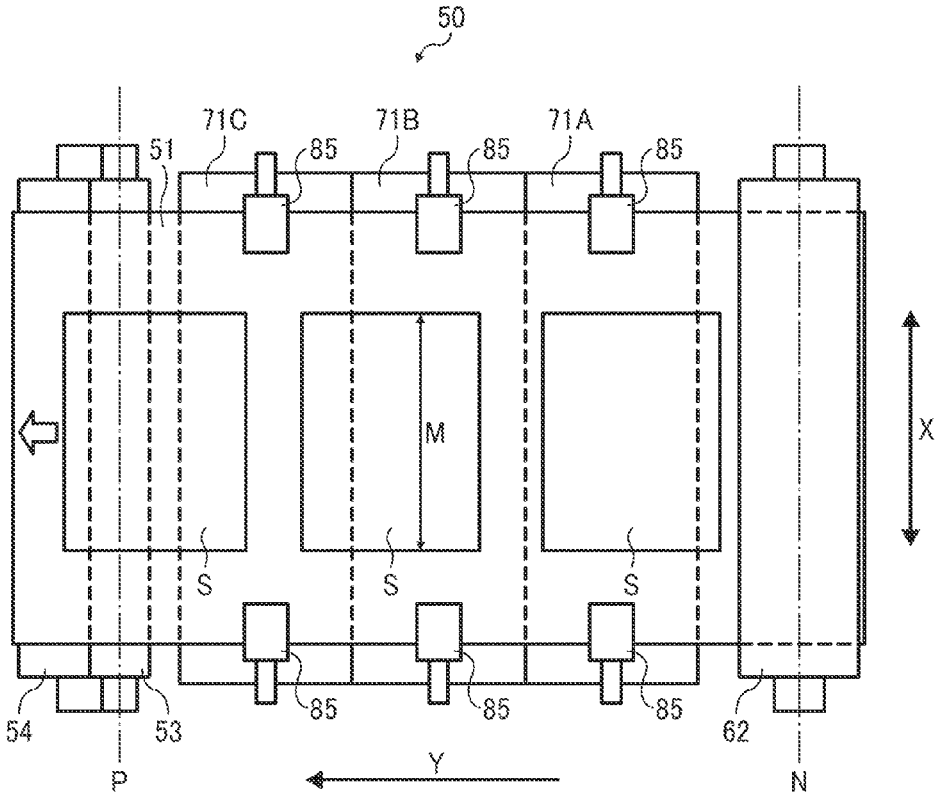
FIG. 8 is a bottom plan view of the glossing device of FIG. 7.

FIG. 8 is a bottom plan view of the glossing device 50 of FIG. 7.

As shown in FIG. 8, in the present embodiment, unlike the foregoing embodiment, the belt retention mechanism comprises one or more pairs of guide rollers 85, each rotatable in contact with the lateral edge of the belt 51 moving between the glossing nip N and the separation position P. For example, where the belt cooler 71 is configured as three independent cooling members as in the present embodiment, three pairs of guide rollers 85 may be provided, each of which guide roller pair 85 is positioned facing an associated one of the multiple cooling members 71A, 71B, and 71C. In this example, all the guide rollers 85 may be of an identical configuration.

Compared to a stationary guide member, use of the guide roller 85 rotatable in contact with the lateral edge of the belt 51 allows for maintaining close, consistent contact between the belt 51 and the belt cooler 71. In addition, the rotatable guide roller 85 does not cause undue frictional resistance against the moving belt 51, leading to secure, reliable operation of the glossing device 50.

With continued reference to FIGS. 7 and 8, the guide roller 85 in the present embodiment is shown positioned facing the belt cooler 71 to define a nip therebetween into which the lateral edge of the belt 51 is inserted.

More specifically, in the present embodiment, the guide roller 85 is configured as a cylindrical rotary body formed of a core or shaft of metal covered with a layer of elastic rubber or resin deposited thereon. The cylindrical rotary body may have its one, free end directed laterally inward, and its other, fixed end directed laterally outward and rotatably supported on a suitable structure, such as, for example, an enclosure housing of the glossing device 50.

Further, in the present embodiment, the glossing device 50 is provided with a rotary driver 90 connected to the guide roller 85 to rotate the guide roller 85 at a linear speed equal to or faster than that of the endless belt 51. For example, the rotary driver 90 may be configured as an electric motor connected to the guide roller 85. The linear speed of the guide roller 85 may be set to a range approximately 1.1 to 1.3 times faster than that of the endless belt 51.

Provision of the rotary driver 90 enables the belt 51 to maintain its proper tension, where the motor-driven guide roller 85 tightens or pulls the belt 51 downward in the conveyance direction Y, which in turn allows the belt 51 to closely contact the belt cooler 71 during conveyance of the recording sheet S between the glossing nip N and the separation position P. Where the belt 51 is tightened fully and sufficiently, the guide roller 85 may slip on the belt 51 to prevent extra tension from acting on the belt 51.

Furthermore, in the present embodiment, the glossing device 50 is provided with a torque limiter 93 connected to the guide roller 85 to limit torque transmitted from the rotary driver 90 to the guide roller 85.

Provision of the torque limiter 93 causes the guide roller 85 to effectively skid or slip on the belt 51 where the belt 51 is tightened fully and sufficiently, so as to reliably protect the belt 51 from excessive load due to tightening with the motor-driven guide roller 85.

Still further, in the present embodiment, the rotary driver 90 is activated in a condition in which the recording medium S is conveyed on the belt 51. That is, where the belt 51 rotates in idle, for example, during warm-up, the rotary driver 90 remains deactivated so that the torque on the guide roller 85 originates solely from friction with the rotating belt 51.

Such arrangement enables the guide roller 85 to tighten the belt 51 only where required, while preventing unnecessary tension on the belt 51, which allows for greater durability and longevity of the belt material.

Yet still further, in the present embodiment, the guide roller 85 has an axis of rotation thereof aligned parallel to a lateral, axial direction X perpendicular to the conveyance direction Y, as shown in FIG. 8.

Figure 9:
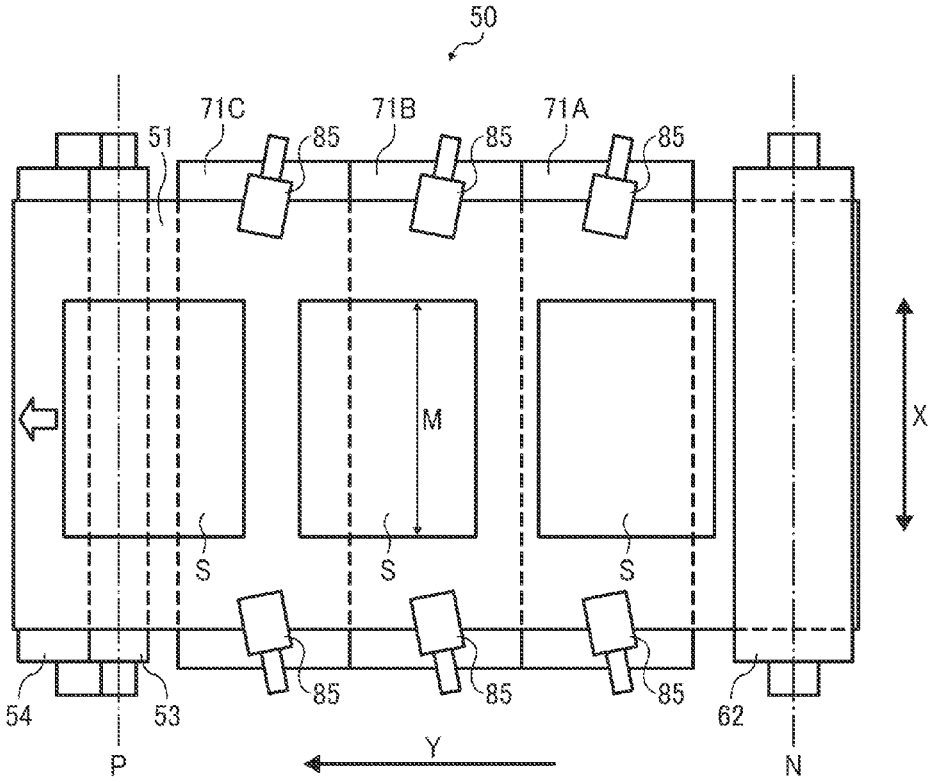
FIG. 9 is a bottom plan view illustrating arrangement of the glossing device of FIG. 7.

Alternatively, instead, the guide roller 85 may have an axis of rotation thereof angled relative to a lateral, axial direction X perpendicular to the conveyance direction Y, so as to stretch the belt 51 outward in the axial direction X, as shown in FIG. 9.

Positioning the axis of rotation of the guide roller 85 angled relative to the axial direction X, that is, causing the roller 85 to have its free end directed downstream and its fixed end directed upstream in the conveyance direction Y, imparts tension outward in the axial direction X to the belt 51, thereby protecting the belt 51 from undesired creases and undulations which would otherwise adversely affect proper media conveyance and glossing performance of the belt assembly.

Figure 10:
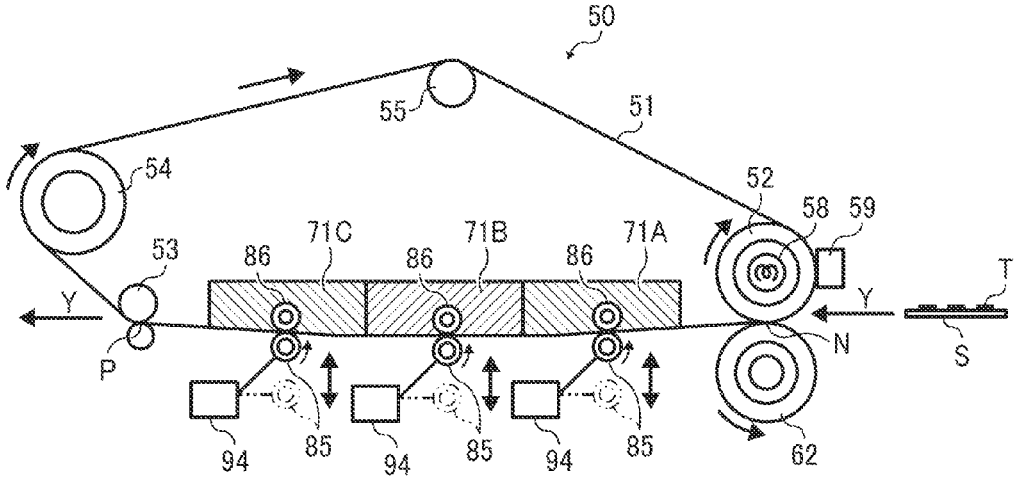
FIG. 10 is an end-on, partially cross-sectional view of the glossing device according to still another embodiment of this patent specification.

FIG. 10 is an end-on, partially cross-sectional view of the glossing device 50 according to still another embodiment of this patent specification, shown with several components omitted for brevity.

As shown in FIG. 10, the overall configuration of the glossing device 50 is similar to that depicted primarily with reference to FIG. 7, except that the glossing device 50 is provided with one or more pairs of backup rollers 86, each positioned opposite the guide roller 85 to define a nip therebetween into which the lateral edge of the belt 51 is inserted.

Provision of the backup roller 86 allows for precise positioning of the belt 51 relative to the belt cooler 71, thereby reliably maintaining close, continuous contact between the belt 51 and the belt cooler 71, while enabling the guide roller 85 to smoothly rotate in contact with the moving belt 51.

Further, in the present embodiment, the glossing device 50 is provided with a biasing mechanism 94, such as a cam, connected to the guide roller 85 to allow positioning the guide roller 85 into and out of contact with the lateral edge of the belt 51. For example, the biasing mechanism 94 may cause the guide roller 85 to contact the lateral edge of the belt 51 in a condition in which the recording medium S is conveyed on the belt 51. That is, the biasing mechanism 94 may cause the guide roller 85 to separate from the lateral edge of the belt 51 where no recording medium S is conveyed on the belt 51.

Provision of the biasing mechanism 94 enables the guide roller 85 to slide against the belt 51 only where required, which allows for greater durability and longevity of the belt material.

Although a particular configuration has been illustrated, the glossing device 50 according to this patent specification may be configured otherwise than that described herein. In each of those alternative embodiments, various beneficial effects may be obtained owing to provision of the belt retention mechanism and other aspects of the glossing device 50 according to this patent specification.

For example, instead of a pressure roller disposed opposite the heat roller via the belt, the pressure member 62 may be configured as an endless, rotatable pressure belt looped into a generally cylindrical configuration.

Further, instead of a multilayered belt, the endless belt 51 may be configured as a monolayer belt formed of a single, uniform layer of suitable belt material.

Furthermore, instead of a halogen heater, the heater 58 may be configured as any heating element, such as a carbon heater, an electromagnetic induction heating coil, or the like.

Moreover, instead of providing the glossing device 50 as peripheral equipment located outside, and connected to, the image forming apparatus 1, the glossing device 50 may be configured as internal equipment of the image forming apparatus 1, in which case the glossing device 50 may be combined with the fixing device 20 into a single, integrated unit that can perform both fixing and glossing on the toner image sequentially inside the image forming apparatus 1.

Further, the number of independent cooling members 71 is not limited to three, and includes any number depending on specific applications. The belt retention mechanism according to several embodiments of this patent specification can work effectively even where the belt 51 is equipped only with a single cooling member, as opposed to providing multiple cooling members to obtain some beneficial effects as described herein.

Furthermore, instead of positioning the belt retention mechanism facing the belt cooler, the belt retention mechanism may be positioned at any position adjacent to a pair of opposed lateral edges of the belt and outboard of a maximum width of the recording medium, insofar as the belt retention mechanism properly serves to retain the belt in continuous contact with the belt cooler between the glossing nip and the separation position.

Numerous additional modifications and variations are possible in light of the above teachings. It is therefore to be understood that, within the scope of the appended claims, the disclosure of this patent specification may be practiced otherwise than as specifically described herein.

What is claimed is:

1. A glossing device for imparting gloss to a toner image formed on a recording medium, the device comprising:

a plurality of rollers disposed generally parallel to each other, including a heat roller subjected to heating;

a looped, endless belt entrained around the plurality of rollers for conveying the recording medium in a longitudinal, conveyance direction thereof;

a pressure member disposed opposite the heat roller to press against the heat roller via the belt to form a glossing nip therebetween, through which the recording medium passes, the recording medium after passage through the glossing nip conveyed on the belt with the toner image adhering to an outer, conveyance surface of the belt, and subsequently separating from the belt at a given separation position downstream from the glossing nip in the conveyance direction;

a belt cooler disposed inside the loop of the belt to cool the belt during movement between the glossing nip and the separation position; and a belt retention mechanism disposed adjacent to a pair of opposed lateral edges of the belt and outboard of a maximum width of the recording medium, the belt retention mechanism including one or more pairs of stationary guide plates fixed in position to contact the lateral edge of the belt moving between the glossing nip and the separation position to retain the belt in continuous contact with the belt cooler between the glossing nip and the separation position.

2. The glossing device according to claim 1, wherein the guide plate is positioned facing the belt cooler to define a gap therebetween into which the lateral edge of the belt is inserted.

3. The glossing device according to claim 2, wherein the gap between the belt cooler and the guide plate is sized no more than ten times the thickness of the belt.

4. The glossing device according to claim 2, further comprising:

a low-friction material disposed on the guide plate to reduce friction where the guide plate contacts the lateral edge of the belt.

5. The glossing device according to claim 1, wherein the belt cooler is positioned immediately above the belt between the glossing nip and the separation position, and the belt retention mechanism is positioned immediately below the belt between the glossing nip and the separation position.

6. The glossing device according to claim 1, wherein the belt cooler comprises:

one or more independent cooling members, disposed in series in the conveyance direction, each of which is operable independently from each other to be cooled to a specific temperature.

7. The glossing device according to claim 1, further comprising;

an auxiliary heater disposed adjacent to the belt cooler to heat the belt cooler.

8. An image forming apparatus incorporating comprising: the glossing device according to claim 1.

9. A glossing device for imparting gloss to a toner image formed on a recording medium, the device comprising:

a plurality of rollers disposed generally parallel to each other, including a heat roller subjected to heating;

a looped, endless belt entrained around the plurality of rollers for conveying the recording medium in a longitudinal, conveyance direction thereof;

a pressure member disposed opposite the heat roller to press against the heat roller via the belt to form a glossing nip therebetween, through which the recording medium passes;

a belt cooler disposed inside the loop of the belt to cool the belt during movement downstream from the glossing nip; and a belt retention mechanism disposed adjacent to a pair of opposed lateral edges of the belt and outboard of a maximum width of the recording medium, the belt retention mechanism including one or more pairs of stationary guide plates fixed in position to contact the lateral edge of the belt moving between the glossing nip and a separation position downstream from the glossing nip to retain the belt in continuous contact with the belt cooler downstream from the glossing nip.

* * * * *